United States Patent [19]

Wolf et al.

[11] 4,196,689

[45] Apr. 8, 1980

[54] APPARATUS FOR DRYING PAPER WEBS OR THE LIKE

[75] Inventors: Robert Wolf, Herbrechtingen; Georg Zürn; Christian Schiel, both of Heidenheim, all of Fed. Rep. of Germany

[73] Assignee: J. M. Voith GmbH, Heidenheim, Fed. Rep. of Germany

[21] Appl. No.: 933,813

[22] Filed: Aug. 15, 1978

Related U.S. Application Data

[63] Continuation-in-part of Ser. No. 759,858, Jan. 17, 1977, abandoned.

[51] Int. Cl.[2] ..... F28F 5/02; F28F 13/18

[52] U.S. Cl. ..... 165/91; 34/124; 165/133; 432/228

[58] Field of Search ..... 165/133, 89, 90, 91, 165/DIG. 8, 94; 34/124, 119; 427/39; 122/DIG. 13; 219/469; 432/60, 228

[56] References Cited

U.S. PATENT DOCUMENTS

| | | | |
|---|---|---|---|
| 1,252,319 | 1/1918 | Bradshaw | 165/133 |
| 2,259,024 | 10/1941 | Cleveland | 165/133 |
| 2,433,121 | 12/1947 | Hornbostel | 165/133 |
| 2,958,742 | 11/1960 | Palmer | 165/89 |
| 2,964,297 | 12/1960 | Davis et al. | 165/133 |
| 4,081,913 | 4/1978 | Salminen | 165/133 |

*Primary Examiner*—Sheldon Richter
*Attorney, Agent, or Firm*—Peter K. Kontler

[57] ABSTRACT

A Yankee clyinder whose internally heated shell consists of steel or cast iron and is provided with an external layer of pure or alloyed copper, molybdenum, tungsten or another metal whose thermal conductivity greatly exceeds (and preferably amounts to at least twice) the thermal conductivity of the material of the shell. The thickness of the layer is in the range of 0.4–2 millimeters, and the thermal expansion coefficient of its material is identical to or approximates that of the material of the shell. The layer can be applied to the periphery of the shell in molten state in the form of a finely atomized spray. The drying action of such cylinder upon a running paper web greatly exceeds the drying action of a cylinder whose shell consists exclusively of cast iron or steel.

8 Claims, 2 Drawing Figures

Fig. 1
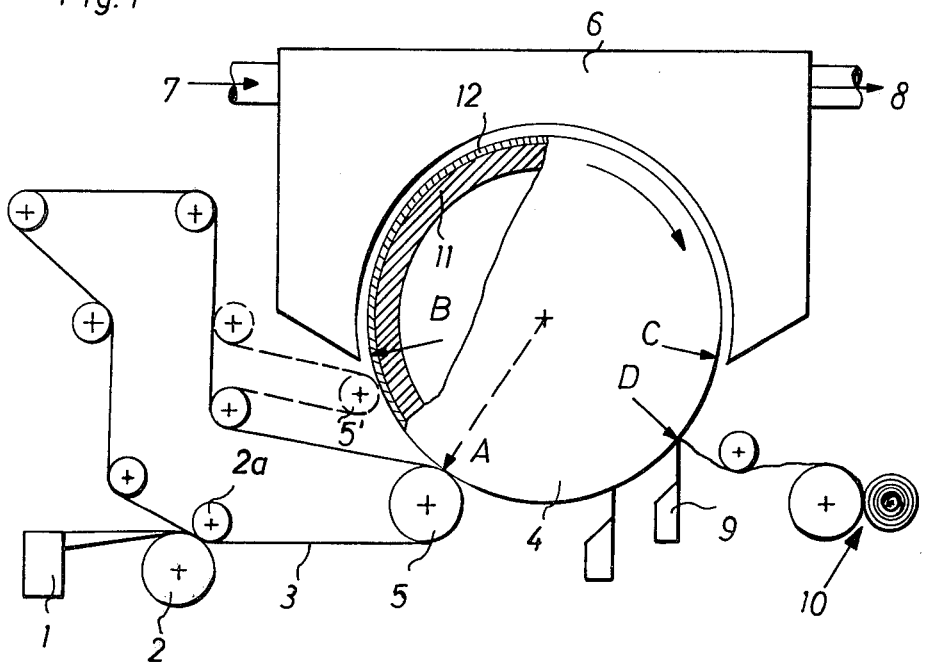
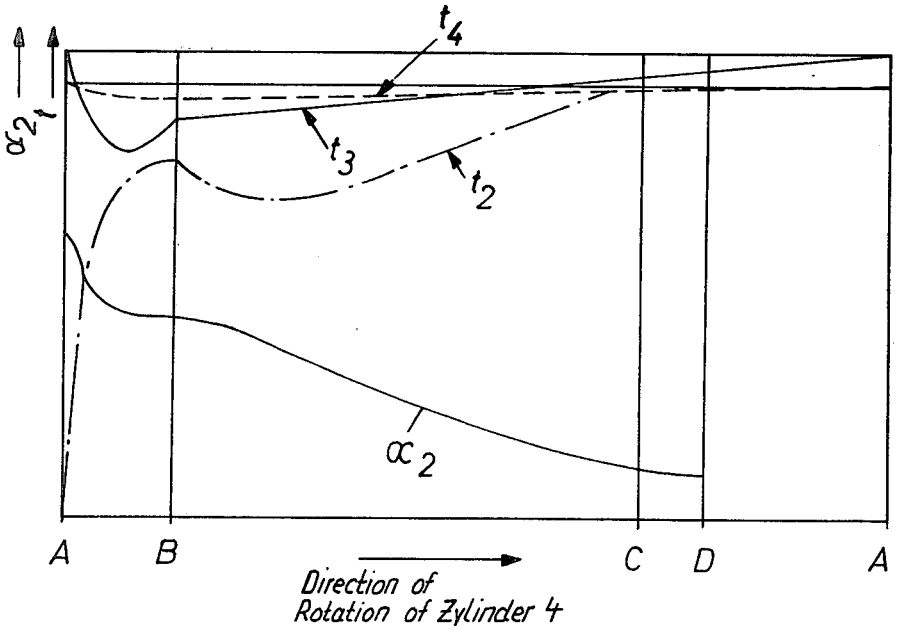
Fig. 2

APPARATUS FOR DRYING PAPER WEBS OR THE LIKE

CROSS-REFERENCE TO RELATED APPLICATION

This is a continuation-in-part of our copending application Ser. No. 759,858 filed Jan. 17, 1977 for APPARATUS FOR DRYING PAPER WEBS OR THE LIKE now abandoned.

BACKGROUND OF THE INVENTION

The present invention relates to papermaking machines in general, and more particularly to improvements in apparatus for expelling moisture from running webs or sheets of fibrous material. Still more particularly, the invention relates to improvements in apparatus wherein a running web of paper or the like is dried during travel along and with the periphery of a rotary heating member, especially a Yankee cylinder.

As a rule, the cylindrical shell of a Yankee cylinder consists of steel or cast iron. The interior of the shell is heated by steam which is maintained at an elevated pressure in order to insure a very high heat energy output, i.e., a pronounced drying action upon the running web during travel along that portion of the path wherein the web is maintained in contact with the periphery of the Yankee cylinder. The shell of the cylinder plays a very important role because its material effects the transfer of heat energy from the interior of the cylinder to the running web. Therefore, manufacturers of Yankee cylinders and analogous rotary drying devices strive to reduce the thickness of the cylinder shell. However, the thickness of the shell cannot be reduced at will since a Yankee cylinder is often quite large and bulky so that its shell must be capable of withstanding very pronounced deforming stresses. Moreover, the cylinder must withstand the pressure of the confined heating medium. Furthermore, and since the thickness of the shell cannot be reduced below a minimum thickness which is still quite substantial, this automatically eliminates the majority of materials having a high thermal conductivity. Such materials include copper and other metals or alloys of equally satisfactory thermal conductivity. Consequently, and as mentioned above, the shells of presently known Yankee cylinders invariably consist of a ferrous metal, primarily cast iron or steel.

OBJECTS AND SUMMARY OF THE INVENTION

An object of the invention is to provide an apparatus for reducing the moisture content of running paper webs, particularly in a Yankee machine, which is not bulkier but whose drying action is much more pronounced than that of conventional apparatus.

Another object of the invention is to provide an apparatus whose superior drying action is achieved without reducing the stability of the apparatus.

A further object of the invention is to provide a novel and improved Yankee cylinder.

An additional object of the invention is to provide a novel and improved cylindrical portion for a rotary moisture-expelling member in a papermaking machine.

An ancillary object of the invention is to provide a novel and improved coating for the shell of a Yankee cylinder or an analogous rotary moisture expelling device.

Still another object of the invention is to provide an apparatus of the above outlined character which can be installed in existing papermaking machines.

Another object of the invention is to provide a relatively inexpensive web drying apparatus whose installation in existing papermaking machines does not necessitate any, or requires only negligible, alterations in the construction of such machines.

The invention is embodied in an apparatus for reducing the moisture content of running paper webs or the like, particularly in a Yankee machine. The apparatus comprises a rotary member (e.g., a Yankee cylinder) including an internally heated hollow cylindrical shell consisting of a first metallic material (preferably cast iron or steel) and a web-containing layer which is applied to the periphery of the shell and consists of a second material (e.g., copper, molybdenum, tungsten or their alloys) whose thermal conductivity exceeds and is preferably at least twice that of the first material. The thickness of the layer may be a minute fraction of the thickness of the shell, e.g., the thickness of the layer may be between 0.4 and 2 millimeters. The thermal expansion coefficient of the first material preferably equals or at least approximates the thermal expansion coefficient of the second material. The layer may be applied by spraying the second material, in molten state and in finely atomized condition, onto the periphery of the shell.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a schematic partly elevational and partly sectional view of a portion of a papermaking machine which embodies the improved apparatus; and FIG. 2 is a chart of temperatures in different regions of the drying zone.

DESCRIPTION OF THE PREFERRED EMBODIMENTS

FIG. 1 shows a portion of a papermaking machine which comprises a headbox 1 having a slice which discharges the suspension into the nip of a breast roll 2 and an associated roll 2*a*. The resulting web is transported by an endless wire or felt 3 and is transferred onto a Yankee cylinder 4 in the region of a press roll 5. The location where the transfer takes place is indicated at A. If desired, the transfer can take place at B; the endless flexible element 3 then transports the web beyond the roll 5 and is relieved of the web in the region of a second press roll 5' which, since optional, is indicated by broken lines.

The upper portion of the Yankee cylinder 4 is surrounded by a preferably gas-fired high-capacity dryer hood 6 which has an inlet 7 for fresh hot air and an outlet 8 for spent air. While travelling from the location B to the location C, the web advances between the shell 11 of the cylinder 4 and the hood 6 and is subjected to a pronounced drying action. The web thereupon continues to adhere to the cylinder 4 on its way to a location D where it is separated, e.g., by a creping blade 9, and is advanced to a winding station 10 which may accommodate a Pope-type reel.

The shell 11 of the Yankee cylinder 4 is relatively thick and is surrounded by a relatively thin layer or coating 12. The layer 12 consists of copper.

The diagram of FIG. 2 shows the shell 11 of the Yankee cylinder 4 in a developed view and illustrates the transfer of heat in the absence and in the presence of the layer 12. The lowermost curve $\alpha_2$ represents the heat transfer between the coated or uncoated shell 11 of the cylinder 4 and the paper web. The rate of heat transfer (as represented by the curve $\alpha_2$) is a factor which influences the density of heat energy flow; such density is the product of the value of $\alpha_2$ and the difference between the temperature at the exterior of the shell and the temperature of the paper web.

The curve $t_2$ of FIG. 2 represents the variations of temperature of the paper web. The curve $t_3$ represents variations of temperature at the exterior of the shell 11 without the layer 12, and the curve $t_4$ represents variations of temperature at the exterior of the improved cylinder 4 (with the layer 12 applied to the periphery of the shell 11). It will be seen that, in the region between the locations B and C, the values represented by the curve $t_4$ exceed the values represented by the curve $t_3$, i.e., the improved cylinder insures a maximum-density flow of heat energy between the composite shell 11, 12 and the paper web. FIG. 2 further shows the advantage of the hood 6 which insures that the major part of heat transfer between the cylinder and the web takes place in the region including the first half of the path of the web from the location B to the location C.

The thickness of the layer 12 is preferably a minute fraction of the thickness of the shell 11, most preferably in the range of 0.4–2 millimeters. The heat expansion coefficient of the material of the layer 12 preferably equals or at least approximates the heat expansion coefficient of the material of the shell 11. For example, the layer 12 can be applied to the shell 11 by resorting to a flame spray coating technique. Copper is but one of the materials which can be used as a coating or layer at the periphery of the shell 11; it is important to select a material whose heat conductivity is pronouncedly higher than (preferably at least two times) that of the shell 11. In addition to copper, such materials include molybdenum, tungsten, their alloys, and certain other metals. As a rule, the shell 11 will be made of cast iron or steel.

The invention is based on the discovery that, by coating the periphery of the cast iron or steel shell 11 with the layer 12 of a metallic material whose heat conductivity greatly exceeds the heat conductivity of the material of the shell 11, the drying action of the cylinder 4 can be enhanced to an unexpected high degree. This is surprising because any thickening of the shell 11 would lead one to expect that the thus thickened shell 11 will offer a greater resistance to the transfer of heat from the cylinder 4 to the paper web. In other words, and since the application of a layer 12 to the exterior of the shell 11 invariably increases the thickness of the thus coated shell 11 (even if the increase of thickness is minimal, e.g., in the range of one or more millimeters or a fraction of one millimeter), such layer 12 would be expected to constitute an additional barrier to the passage of heat energy even if the heat conductivity of the material of the layer greatly exceeds the heat conductivity of the material of the main portion of the cylinder 4.

The ability of the improved cylinder 4 to furnish a more satisfactory drying action is attributed to the following relationship between the influence of the paper web upon the cylinder 4 and vice versa: The web which is transported toward and reaches the periphery of the cylinder 4 (e.g., at the location B) is moist and relatively cold. Therefore, the web reduces the temperature at the exterior of the shell 11 in the region where the exterior of the cylinder 4 comes into contact with successive increments of the running web. The temperature at the exterior of the cylinder 4 rises in a direction from the location B toward the location C since the interior of the cylinder 4 contains a supply of heating medium. However, in the absence of the layer 12, the temperature rise at the exterior of the cylinder 4 is not sufficient (at least along the major portion of the web path between the locations B and C) to enable the exterior of the cylinder 4 to reassume that relatively high temperature which prevails immediately upstream of the zone of initial contact between the moist and relatively cool web and the cylinder 4. Such reduction of temperature at the exterior of the cylinder 4 is undesirable since the intensity of the web drying action increases proportionally with increasing temperture at the cylinder 4.

When the shell 11 is coated with the layer 12 whose thermal conductivity greatly exceeds the thermal conductivity of the material of the shell 11, a certain amount of cooling of the layer 12 will take place in the region where successive increments of the running web reach the layer 12, i.e., in the region of the roll 5 or 5' shown in FIG. 1. However, the temperature of the layer 12 rises much more rapidly than the temperature of the shell 11 without such layer 12 (compare the curves $t_3$ and $t_4$ of FIG. 2). In other words, the higher thermal conductivity of its material enables the layer 12 to more rapidly compensate for the drop of temperature at the location of initial contact between such layer 12 and the web. This evidently enhances the drying action of the improved cylinder 4. The extent to which the drying action of the improved cylinder 4 exceeds that of a conventional cylinder depends on thermal conductivity of the layer 12. The thickness of the layer 12 also influences the extent of improved drying action; in general, the drying action will be more satisfactory if the thickness of the layer 12 is increased. However, and as mentioned above, layers 12 having a thickness in the range of a small fraction of one millimeter have been found to greatly improve the drying action of the cylinder. In fact, the improvement of drying action by resorting to an extremely thin layer 12 is quite surprising and exceeds all expectations. As mentioned above, the provision of the hood 6 which surrounds that portion of the web which is in contact with the layer 12 also contributes to the improved drying action. When using the hood 6, it is particularly important to insure that the temperature at the exterior of the cylinder 4 in the region where the cylinder 4 is surrounded by the hood 6 is as high as possible. A Yankee cylinder is a preferred type of rotary body whose shell is constructed in accordance with the present invention; the combination of a Yankee cylinder with a press roll (5 or 5') and the hood 6 has been found to insure a superior drying action.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for reducing the moisture content of running paper webs or the like, particularly, in a Yankee machine, comprising a rotary member including a hollow cylindrical shell which is internally heated by a fluid at elevated pressure and externally juxtaposed over a large area with the web during the operation of the apparatus, and which consists of a first metallic material selected from the group consisting of cast iron and steel, and means for increasing heat transfer within said area from said rotary member to the web, including a web-contacting layer applied to the periphery of said shell and consisting of a second metallic material whose thermal conductivity considerably exceeds the thermal conductivity of said first material.

2. Apparatus as defined in claim 1, wherein the thickness of said layer is between 0.4 and 2 millimeters.

3. Apparatus as defined in claim 1, wherein the thermal expansion coefficient of said first material at least approximates the thermal expansion coefficient of said second material.

4. Apparatus as defined in claim 1, wherein said layer is a molten-state spray-deposited layer of said second material on the periphery of said shell.

5. Apparatus as defined in claim 1, wherein said second material is selected from the group consisting of copper, molybdenum, tungsten and their alloys.

6. Apparatus as defined in claim 1, further comprising means for pressing successive increments of the web against said layer in a first region, means for separating the web from said layer in a second region located downstream of said first region, as considered in the direction of rotation of said member, and a dryer hood overlying said layer intermediate said regions.

7. Apparatus as defined in claim 1, wherein said rotary member is a Yankee cylinder.

8. Apparatus as defined in claim 1, wherein the thickness of said layer is a minute fraction of the thickness of said shell.

* * * * *